US006041570A

United States Patent [19]

Descalzo

[11] Patent Number: 6,041,570

[45] Date of Patent: Mar. 28, 2000

[54] PALLETIZING METHOD WITH COMPRESSIVE STRENGTH REINFORCEMENT

[75] Inventor: Jean-Claude Descalzo, Franconville, France

[73] Assignee: Compagnie Laitiere Europeenne, France

[21] Appl. No.: 09/029,423

[22] PCT Filed: Sep. 3, 1996

[86] PCT No.: PCT/FR96/01343

§ 371 Date: Mar. 4, 1998

§ 102(e) Date: Mar. 4, 1998

[87] PCT Pub. No.: WO97/09246

PCT Pub. Date: Mar. 13, 1997

[30] Foreign Application Priority Data

Sep. 4, 1995 [FR] France ..... 95 10332

[51] Int. Cl.[7] ..... B65D 19/38

[52] U.S. Cl. ..... 53/158; 53/139.7; 53/447; 108/57.22; 108/57.23

[58] Field of Search ..... 53/139.7, 158, 53/447; 206/386; 108/57.21, 57.22, 57.23, 57.24

[56] References Cited

U.S. PATENT DOCUMENTS

| | | | |
|---|---|---|---|
| 3,487,918 | 1/1970 | Roden et al. | 206/65 |
| 3,529,717 | 9/1970 | McDougal | 206/65 |
| 3,783,579 | 1/1974 | Howe | 53/24 |
| 4,244,471 | 1/1981 | Plante | 206/586 |
| 4,535,587 | 8/1985 | Rias | 53/436 |
| 4,919,270 | 4/1990 | Govang et al. | 206/597 |
| 5,435,677 | 7/1995 | Gonzalez | 410/156 |
| 5,457,938 | 10/1995 | Butterfield et al. | 53/399 |
| 5,647,191 | 7/1997 | Villemure | 53/447 |
| 5,687,847 | 11/1997 | Culpepper et al. | 206/430 |

*Primary Examiner*—Joseph J. Hail, III
*Assistant Examiner*—William Hong
*Attorney, Agent, or Firm*—Ostrolenk, Faber, Gerb & Soffen, LLP

[57] ABSTRACT

The invention relates to a palletising method with compressive strength reinforcement. The method includes the steps of stacking packages (20) comprising one or more holes (22) passing vertically through each of said packages (20) so as to form a lower package assembly (20*a*) and such that the holes (22) are aligned and that the height of said lower assembly (20*a*) is equal to that of compressive strength reinforcement posts (30), inserting at least three posts (30) in holes (22) of the lower assembly so that the posts (30) extend vertically, placing an intermediate plate (40) such that it rests on the upper end of the posts (30) and stacking an upper package assembly (20*b*) on said plate (40). The invention is useful for transporting and handling fresh produce.

13 Claims, 4 Drawing Sheets

PALLETIZING METHOD WITH COMPRESSIVE STRENGTH REINFORCEMENT

The invention relates to a palletising method with compressive strength reinforcement and to the device enabling this method to be carried out.

Known methods of palletising allow storage, transport and handling of batches of packed products stacked on one another.

It is therefore necessary to have packages whose compressive strength withstands the weight of all the products stacked thereabove. The compressive strength of each package is strongly associated with the quantity of raw material used which, most of the time, is cardboard made from a paper pulp or any other material. One purpose of the invention is to provide a method of palletising with compressive strength reinforcement which makes it possible to reduce the quantity of raw material necessary for manufacturing packages while maintaining an identical complete palletising load. It is also necessary that the packages located in the lower part of the loaded pallet do not collapse.

According to the invention, this purpose is attained by a palletising method with compressive strength reinforcement, which comprises the following steps of:

providing a pallet, of width L1 and of depth P1, intended to receive a load of total height H1, providing packages of height H2, each package having at least one hole passing right through the package over the height of the package, the hole issuing from at least one lower perforation, providing compression reinforcement posts whose height H3 is a multiple of the height H2 of the packages, the posts being able to be inserted at least in certain of the holes, providing at least one intermediate plate, stacking a first series of packages on the pallet, the packages constituting a lower package assembly, so that the holes are aligned and with the result that the height of the lower package assembly is equal to the height H3 of the posts, inserting at least three of the posts in holes in the lower package assembly which may serve as guide for the posts, with the result that the posts are vertical, placing the intermediate plate on the lower package assembly with the result that the plate rests on the upper end of the posts, and stacking a second series of packages on the intermediate plate, the packages constituting an upper package assembly.

It is advantageously provided that the packages are rectangular parallelepipeds and that four posts are inserted in holes located in the corner zones of the lower package assembly.

Thanks to this method, the vertical compressive strength of an assembly of packages stacked in the lower part of a loaded pallet is reinforced in simple manner.

According to an advantageous characteristic, all the packages comprise a plurality of holes: certain of these holes can serve as guide for the posts, while the other holes serve for ventilation of the stacked packages and the intermediate plate is perforated with the result that hollowed parts of the plate are at least partially opposite the holes serving for ventilation of the packages.

Thus, a ventilation of the interior of the packages is possible as the air may circulate via the ventilation holes which form therebetween vertical ventilation chimneys. This is sometimes indispensable when the products transported are perishable foodstuffs such as fresh produce such as cheese.

In the case of transporting certain perishable products, the packages used up to the present time are already perforated with a view to the ventilation indispensable for good preservation of these products. It is in that case easy to apply the palletising method according to the invention. The structure and the arrangement on the pallet of these packages is conserved, while reducing their composition: less raw material is used for the packages without modifying the total load which may be palletised nor the useful volume available for the product in the package.

Another purpose of the invention is to produce a palletising device which presents the advantages mentioned hereinabove.

This other object is realized thanks to a palletising device for the stacking of packages of height H2 comprising holes passing right through the packages in vertical direction, each of the holes issuing at least from a lower perforation, where there is provided:

a pallet intended to receive a load of total height H1 constituted by the assembly of the stacked packages, compressive strength reinforcement posts whose height H3 is a multiple of the height H2 of the packages and intended to be placed vertically in holes which may serve as guide, with the result that their upper end is at the level of the upper edge of the vertical walls of the packages which contain the upper terminal part of the posts, and a intermediate plate intended to rest on the upper end of the posts.

According to an advantageous characteristic, the height H3 of the posts is equal to three times the height H2 of the packages when the packages have been stacked.

The invention will be more readily understood and secondary characteristics and their advantages will appear in the course of the description of an embodiment given hereinbelow by way of example.

It is understood that the description and the drawings are given only by way of indicative and non-limiting example.

Reference will be made to the accompanying drawings, in which.

Figure 3:
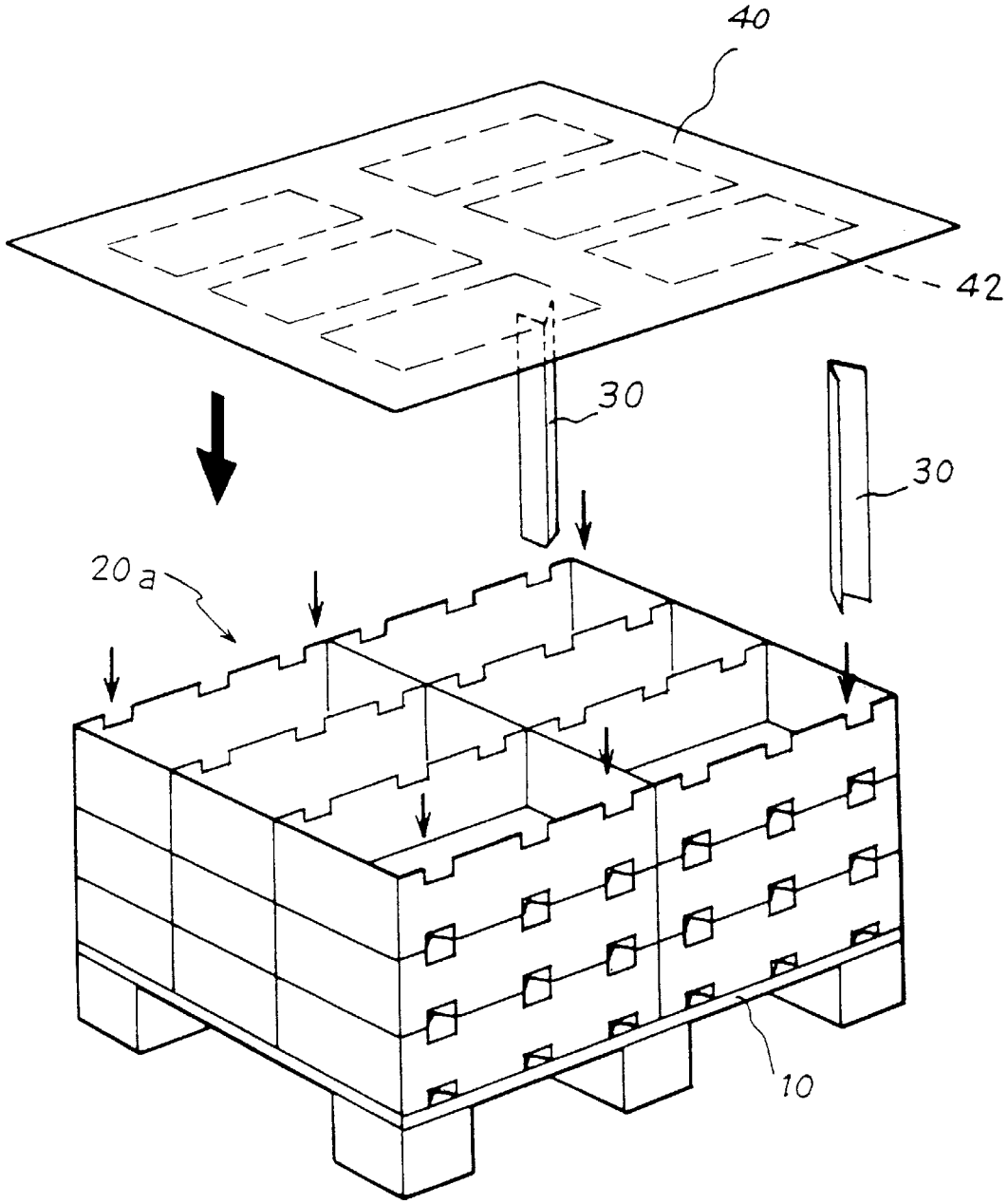
FIG. 3 is a schematic perspective view of an intermediate step in the palletising method according to the invention.
Figure 4:
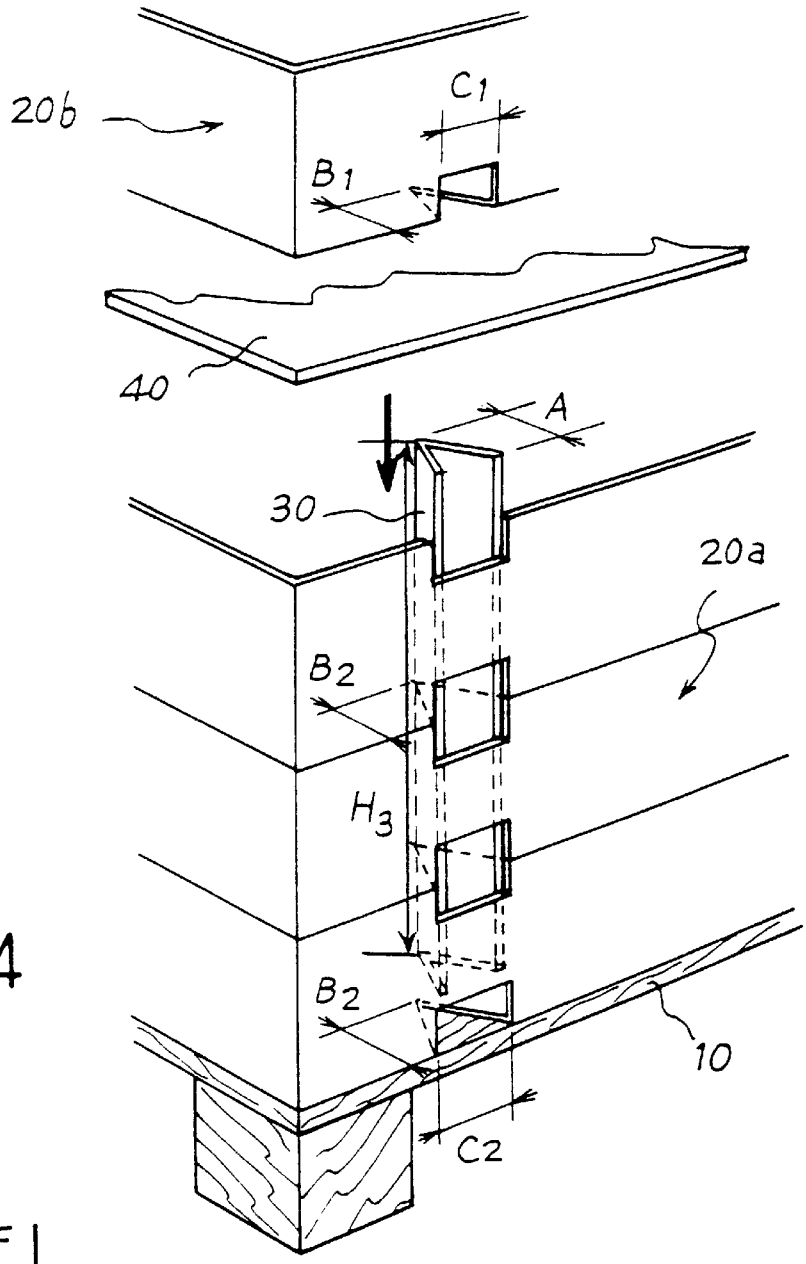

FIG. 4 relates to a detailed zone of FIG. 3.

Figure 5:
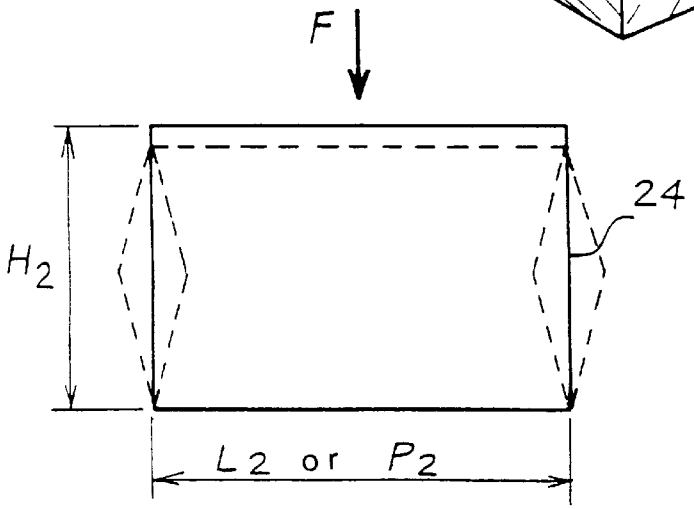

FIG. 5 represents the phenomenon of bending of a lateral face of a package.

Figure 1:
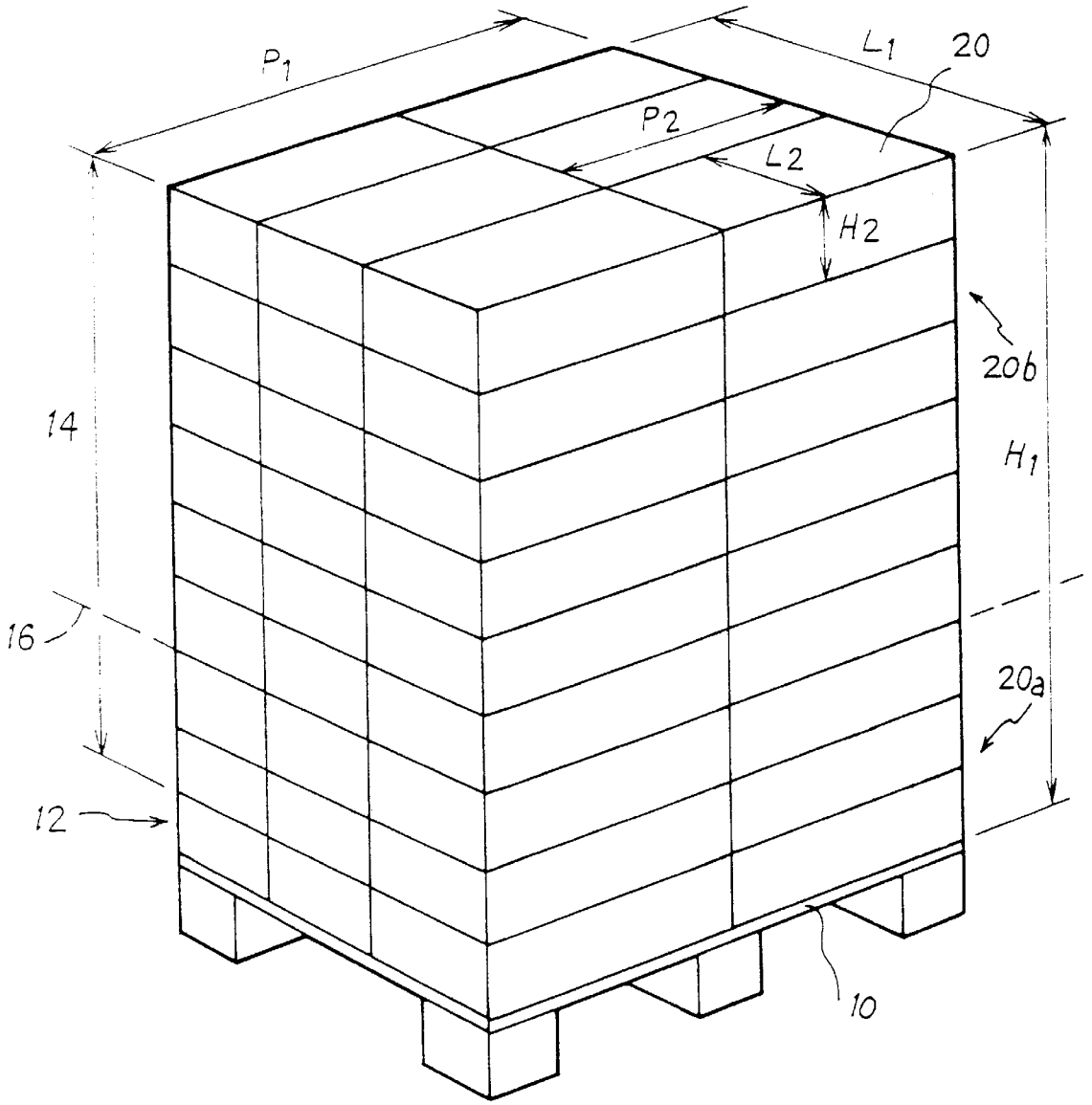
FIG 1 PRIOR ART
FIG. 1 is a schematic perspective view of a loaded pallet of the prior art.

According to FIG. 1, the palletising method known by the prior art consisted in stacking packages 20 in orderly manner on a transport pallet 10. This pallet 10 is constituted by a base comprising a platform and feet between which is provided the passage of the fork of fork-lift trucks or like devices.

Parallelepipedic packages 20 of width L2, of depth P2 and of height H2 are conventionally stacked regularly to form a complete parallelepipedic palletising load of width L1, of depth P1 and of height H1. The width L1 and the depth P1 of the total load are respectively multiples of the width L2 and depth P2 of the packages 20. In order to optimalize the volume of the total load of each pallet, the width L1 and the depth P1 of this load are respectively equal to the width and depth of the pallet 10.

The stacking of the packages 20 forms superposed successive layers, each of the packages of a layer supporting the weight of the packages located thereabove. For example, if reference is again made to FIG. 1, each package of the lower layer 12 supports all the packages of the upper layers 14 which are directly located above this package.

If the need for vertical compressive strength per level is observed, it decreases as the load located above this level decreases. This observation has made it possible to design a reinforcement system ensuring vertical compressive strength of the bottom of the loaded pallet and thus rendering possible the reduction of the composition of the packages for the loaded pallet assembly.

It is observed that, from a certain level (reference 16 in FIG. 1) corresponding to less than one third of the height H1 of the total load of the pallet, the need for vertical compressive strength is reduced by about 50%.

Figure 2A:
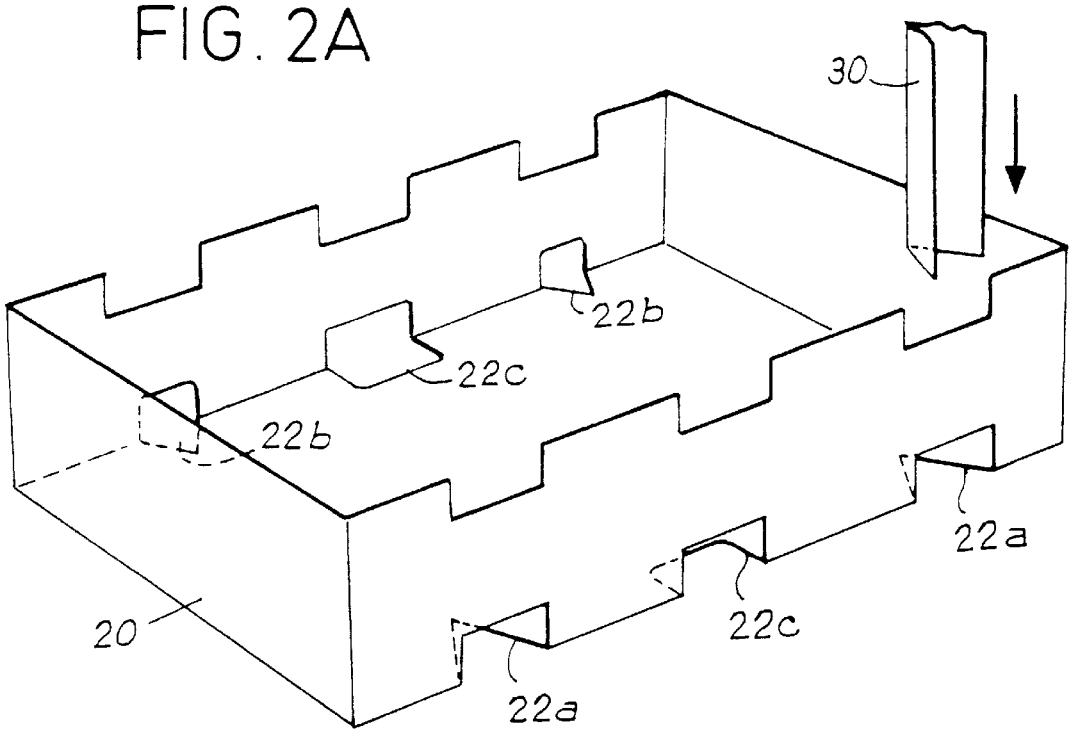
FIG. 2A is a schematic perspective view of a package stacked in the lower package assembly in the course of an intermediate step of the palletising method according to the invention.

According to the invention, the packages 20 are identical and necessarily perforated right through. An example of perforation is shown in FIG. 2A: at least one lower perforation is located in the lower horizontal wall or bottom of the packages 20. Packages may be used with a bottom and an upper horizontal wall, in that case each lower perforation lies opposite an identical upper perforation located in the upper horizontal wall of the packages 20.

In the example shown, the packages 20 do not comprise an upper horizontal wall but only a bottom or lower horizontal wall and four vertical side walls. As may be seen in FIGS. 2A and 2B, there are six lower perforations which are at the edge of the lower horizontal wall and extend in a part of the widest side wall or widest face which is consecutive to the perforated horizontal wall and to the perforations.

Not having corresponding perforations in an upper horizontal wall, the lower perforations located in the bottom of the packages 20 constitute holes opposite one another when the packages are stacked in the same direction.

Figure 2B:
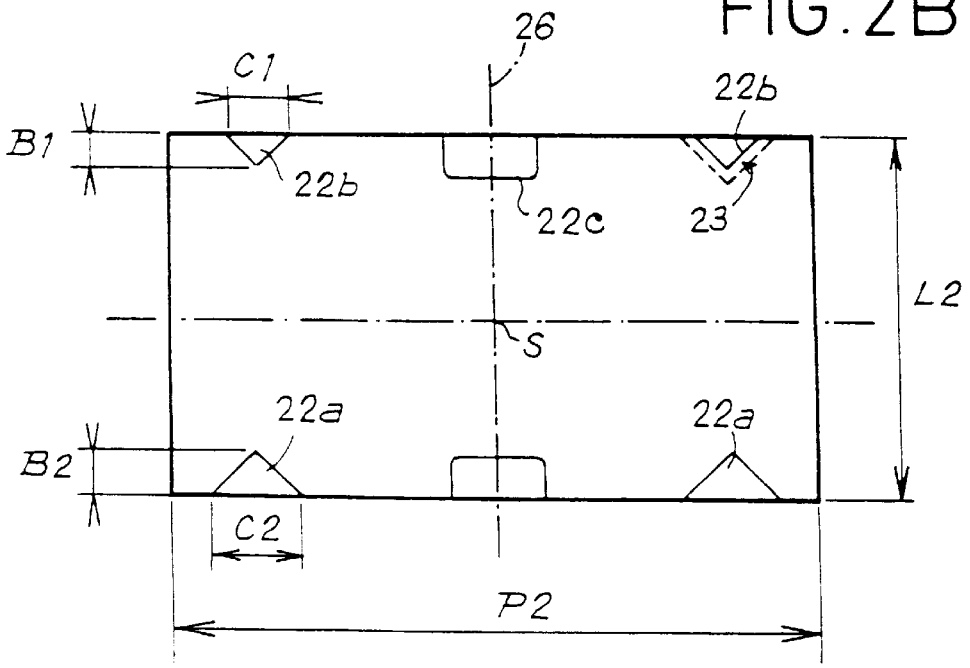
FIG. 2B is a plan view of the package shown in FIG. 2A.

As may be seen in FIGS. 2A and 2B, the bottom of each package 20 presents an axis of symmetry 26 parallel to the width L2 of the package and which cuts at right angles the depth P2 (or length) into two identical portions and a centre of symmetry S located at the intersection of the diagonals of the rectangular bottom.

The bottom of each package 20 firstly comprises two large triangular perforations 22*a* of which one of the sides follows the widest edge of the bottom and constitutes a base of width C2, the large triangle advancing in the direction of the opposite edge over a distance B2 corresponding to the height of the large triangle.

The two large triangular perforations 22*a* are located on either side of the axis of symmetry 26.

A first rectangular perforation 22*c* is located between the two large triangular perforations 22*a* and might present any other shape of contour. A second rectangular perforation 22*c* is the symmetry of the first rectangular perforation 22*c* with respect to the centre of symmetry S.

The lower perforations (22*a*, 22*b*, 22*c*) of the packages 20 preferably comprise at least one small lower perforation 22*b* whose dimensions are smaller than those of the holes 22*a* which may serve as guide for the posts 30 and located symmetrically to the lower perforation of these holes 22*a* with respect to the centre of symmetry S of the lower horizontal wall of the packages 20 and at least the packages 20 of the first layer of said upper package assembly 20*b* are stacked after having undergone a rotation through 180° about a vertical axis with respect to the packages 20 of said lower package assembly 20*a*, with the result that the posts 30 are in line with the small lower perforations 22*b* of the first layer of the upper package assembly 20*b*.

In the embodiment shown, there are, on either side of the second rectangular perforation 22*c*, two small triangular perforations 22*b* which are the symmetries of the large triangular perforations 22*a* with respect to the centre of symmetry S. The small triangular perforations 22*b* have a base of width C1 and a height B1 which are respectively smaller than the width C2 and the height B2 of the large triangular perforations 22*a*.

When two packages 20 are stacked inverted, i.e. the package located above has undergone a rotation through 180° about a vertical axis with respect to the package underneath, this configuration allows each of the two large triangular perforations 22*a* of the package underneath to be aligned vertically with one of the two small triangular perforations 22*b* of the package located above. In this configuration, by making the vertical projection of the contour of a large triangular perforation 22*a* of the package underneath on the bottom of the package located above, the contour shown in broken lines in FIG. 2B is obtained. The zone of the surface of the bottom of the package located above included between the contour in broken lines and the contour of the small triangular perforation 22*b* which is located recessed with respect to the contour in broken lines corresponds to a bearing zone 23 of which the role will be described hereinbelow.

In order to reinforce ventilation between the stacked packages 20, each of the two widest side walls presents three perforations which are, in the example shown in FIG. 2A, similar to the rectangular perforations 22*c*, located in the vertical alignment of the perforations of the bottom of the package and open out at the upper end of the side walls.

The large triangular perforations 22*a* are dimensioned to allow passage of a post 30 and the other perforations are intended to ventilate the interior of the packages 20.

FIG. 3 shows a lower assembly 20*a* of packages 20 constituted by three layers of packages through which are inserted six vertical compressive strength reinforcement posts 30. Eight or even more posts 30 may be provided as a function of the type of package 20, the number of these packages 20 per level and the load of each of the packages.

Thanks to the alignment of the holes 22*a*, the lower end of each post 30 rests on the platform of the pallet 10. The upper end of each post 30 is in that case at the level of the upper end of the vertical walls of the packages 20 of the third layer or upper layer of the lower package assembly 20*a*.

The intermediate plate 40 is then laid, which rests on the upper end of the posts 30 and on the upper end of the vertical walls of the packages of the upper layer of the lower package assembly 20*a*.

The last step consists in stacking the packages constituting the upper package assembly 20*b*: they are inverted with respect to the packages of the lower package assembly 20*a*, as they have undergone a rotation through 180° about a vertical axis with respect to the packages of the lower package assembly 20*a*.

The posts 30 and the lower package assembly 20*a* support the weight of the upper package assembly 20*b* which will for example be constituted by six layers of packages 20. The weight of this upper package assembly 20*b* is distributed on the posts 30 and on the intermediate plate 40.

The intermediate plate 40 serves as abutment or element for levelling between the upper package assembly 20*b* and the lower package assembly 20*a*. The posts 30 being more resistant to vertical compression than the lower package assembly 20*a*, they do not collapse. It is therefore necessary that the intermediate plate 40 does not deform due to the tendency to punching by the posts 30 which counterbalances the weight of the upper package assembly 20*b*. In order not to have to provide an intermediate plate 40 having a greater composition of raw material, it has been thought to reinforce this intermediate plate 40 by the bottom of the packages of the lower layer of the upper package assembly 20*b*.

It is the role of the bearing zone 23 described hereinbefore: on the upper end of each post 30 there successively rests the intermediate plate 40, a bearing zone 23, constituted by a zone of the bottom of a package, then the contents of this package and other packages stacked above. There are therefore two thicknesses of cardboard above the upper end of each post 30, which avoids any deformation due to the posts 30.

Furthermore, as shown in FIG. 4, it is provided that the outer contour of the posts 30, in section in a plane perpendicular to their height H3, has a profile whose width A is identical to the width B2 of the holes 22*a* which may serve as guide for the posts 30.

It is also possible that the outer contour of the posts 30, in section in a plane perpendicular to their height H3, is substantially identical to the inner contour of the holes 22*a* that may serve as guide for the posts 30.

In the preferred embodiment (cf. FIGS. 3 and 4), the posts 30 have a V-shaped profile, the perforations 22*a*, 22*b* having an inner contour of triangular shape.

Moreover, according to an advantageous characteristic, in order to form the posts, the recessed parts 42 are cut out in the intermediate plate 40 and the posts 30 are formed by folding in the cut-out parts of the intermediate plate 40 so that the zones of the intermediate plate 40 which rest on the upper ends of the posts 30 do not belong to the recessed parts 42.

This solution is economical since the post 30 is made from a flat cut-out with grooves which will be taken from said plate 40, simultaneously creating the recessed part 42 which ensures vertical ventilation.

With reference more precisely to FIG. 4, the dimensions of the large triangular perforations 22*a* and those of the post 30 are provided so that the post 30 follows the contour of the perforation 22*a*: this is possible as the post presents a certain elasticity due to its V form. This enables the post 30 to be in horizontal abutment with the large triangular perforations 22*a* and thus to reinforce the vertical compressive strength and the resistance to horizontal bending of each package of the lower package assembly 20*a*.

In fact, as shown in FIG. 5, the lateral sides of the packages 20 of the lower package assembly 20*a* have a rectangular contour 24 (solid lines) of width H2 and of length L2 or P2. Without the posts 30, under the weight of the packages of the upper assembly 20*b*, the vertical compressive force F is appled on the lateral side whose lateral edges finish by folding and an inwardly or outwardly deformed contour of the lateral side is obtained (broken lines in FIG. 4). Thanks to the posts 30, the vertical walls of the packages 20 of the lower package assembly 20*a* resist bending better.

According to another characteristic, the height of the lower package assembly 20*a* is at the most equal to a third of the total height H1 of the lower (20*a*) and upper (20*b*) package assemblies when the packages are stacked on the pallet 10.

What is claimed is:

1. Palletizing method of packages, comprising the following steps:

providing a pallet for receiving a load formed by stacked packages, providing packages of height H2, each package having at least one guide hole passing right through said package over the whole height of said package, providing compression reinforcement posts having an upper end, a lower end and a height H3 which is less than or equal to a multiple of said height H2 of said packages, said posts being able to be inserted in said guide hole, providing at least one intermediate plate, stacking a first series of packages on said pallet so that said guide holes are vertically aligned and with the result that the total height of said first series of packages is less or equal to said height H3 of said posts, inserting at least three of said posts in said guide holes of said first series of packages whereby said posts are vertically maintained by said aligned guide holes and said lower end of said posts rests on said pallet, placing said intermediate plate on said upper end of said posts, and stacking a second series of packages on said intermediate plate.

2. Palletizing method according to claim 1, wherein said packages further comprise ventilation holes for ventilating said stacked packages.

3. Palletizing method according to claim 2, wherein said intermediate plate has recessed parts which are designed to at least partially face some of said ventilation holes of said first and second series of packages.

4. Palletizing method according to claim 3, wherein said recessed parts are cut out in said intermediate plate by creating cut-out parts, said cut-out parts being folded along a line for forming said posts whereby said posts have a V-shaped profile, said intermediate plate resting on said upper end of said posts by rest zones which do not belong to said recessed parts.

5. Palletizing method according to claim 1, wherein said guide holes have an inner contour and said posts have an outer contour, in section in a plane perpendicular to said height H3 of said posts, which is substantially identical to said inner contour.

6. Palletizing method according to claim 1, wherein said guide holes have a width B2 and said posts have an outer contour, in section in a plane perpendicular to said height H3 of said posts, said outer contour having a profile whose width A is identical to said width B2 of said guide holes.

7. Palletizing method according to claim 6, wherein each of said packages has a lower horizontal wall with a center of symmetry S and with lower perforations, said lower perforations comprising at least one guide lower perforation from which said guide hole is issued and having said width B2, and at least one small lower perforation of which the dimensions are smaller than those of said guide lower perforation, said small lower perforation being located symmetrically to said guide lower perforation with respect to said center of symmetry S and wherein said second series of packages comprise at least a first layer of packages which are stacked on said intermediate plate after having undergone a rotation through 180° about a vertical axis with respect to said first series of packages, with the result that said posts are in vertical alignment with one of said small lower perforations of said first layer of packages.

8. Palletizing method according to claim 1, wherein said posts have an outer contour, in section in a plane perpendicular to said height H3 of said posts, said outer contour having a V-shaped profile, said guide holes having an inner contour of triangular shape.

9. Palletizing method according to claim 1, wherein said height of said first series of packages is at the most equal to one third of the total height H1 of said first and second series of packages when said packages are stacked on said pallet.

10. Palletizing method according to claim 1, wherein said packages are rectangular paralleledpipeds and wherein four posts are inserted in said guide holes which are located in corner zones of said first series of packages.

11. Palletizing device for stacking packages having vertical walls of height H2 with an upper edge and comprising guide holes passing right through said packages in the vertical direction, said palletizing device comprising:

a pallet for receiving a load having a total height H1 and constituted by the stacked assembly of said packages, at least three compressive strength reinforcement posts having an upper end, a lower end, an upper terminal part and a height H3 which is less than or equal to a multiple of said height H2 of said packages, said posts being intended to be positioned and maintained vertically in said guide holes whereby said upper end of said posts is nearly or at the level of said upper edge of said vertical walls of said packages which contain said upper terminal part of said posts and said lower end of said posts rests on said pallet, and an intermediate plate intended to rest on said upper end of said posts.

12. Palletizing device according to claim 11, wherein said height H3 of said posts is equal to three times said height H2 of said packages.

13. Palletizing device according to claim 11, wherein each of said packages has a lower horizontal wall with a center of symmetry S and with lower perforations, said lower perforations comprising at least one guide lower perforation from which said guide hole is issued and at least one small lower perforation of which the dimensions are smaller than those of said guide lower perforation, said small lower perforation being located symmetrically to said guide lower perforation with respect to said center of symmetry S.

* * * * *